US009388665B2

(12) United States Patent
Caminari

(10) Patent No.: US 9,388,665 B2
(45) Date of Patent: Jul. 12, 2016

(54) UNDERBALANCE ACTUATORS AND METHODS

(71) Applicant: Schlumberger Technology Corporation, Sugar Land, TX (US)

(72) Inventor: Richard T. Caminari, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 320 days.

(21) Appl. No.: 13/910,204

(22) Filed: Jun. 5, 2013

(65) Prior Publication Data

US 2013/0327538 A1 Dec. 12, 2013

Related U.S. Application Data

(60) Provisional application No. 61/658,799, filed on Jun. 12, 2012.

(51) Int. Cl.

| | |
|---|---|
| ***E21B 34/06*** | (2006.01) |
| ***E21B 34/00*** | (2006.01) |
| ***E21B 34/14*** | (2006.01) |
| ***E21B 23/04*** | (2006.01) |
| ***E21B 34/10*** | (2006.01) |

(52) U.S. Cl.

CPC ..... *E21B 34/14* (2013.01); *E21B 23/04* (2013.01); *E21B 34/10* (2013.01)

(58) Field of Classification Search

CPC ..... E21B 34/10; E21B 34/14; E21B 34/00; E21B 23/04; E21B 23/004; E21B 23/006

USPC ..... 166/373, 332.1

See application file for complete search history.

(56) References Cited

U.S. PATENT DOCUMENTS

| | | | | |
|---|---|---|---|---|
| 6,035,880 | A | 3/2000 | Gazda | |
| 7,743,833 | B2 | 6/2010 | Cascario et al. | |
| 2005/0224235 | A1 | 10/2005 | Patel | |
| 2008/0128137 | A1 | 6/2008 | Anderson et al. | |
| 2009/0218096 | A1 | 9/2009 | Vick, Jr. et al. | |
| 2009/0242199 | A1 * | 10/2009 | Basmajian et al. | 166/255.2 |
| 2011/0083859 | A1 * | 4/2011 | Scranton et al. | 166/374 |
| 2013/0118758 | A1 * | 5/2013 | Caminari | 166/373 |

OTHER PUBLICATIONS

International Search Report and Written Opinion mailed on Sep. 11, 2013 for International Patent Application No. PCT/US2013/045068, filed on Jun. 11, 2013, 9 pages.

* cited by examiner

*Primary Examiner* — Kenneth L Thompson
*Assistant Examiner* — Michael Wills, III
(74) *Attorney, Agent, or Firm* — David J. Groesbeck

(57) ABSTRACT

An actuation method according to one or more embodiments includes axially translating an operator in a first direction in response to applying a tubing pressure to a first side in excess of an annulus pressure acting on a second side, axially translating the operator in a second direction to an actuation position in response to applying an underbalance pressure level to the operator and operating a tool element from a first position to a second position in response to translating the operator to the actuation position.

10 Claims, 4 Drawing Sheets

UNDERBALANCE ACTUATORS AND METHODS

This application claims the benefit of and priority to U.S. Provisional Application Ser. No. 61/658,799, filed Jun. 12, 2012, which is incorporated by reference herein.

BACKGROUND

Hydrocarbon fluids such as oil and natural gas are obtained from a subterranean geological formation, referred to as a reservoir, by drilling a well that penetrates the hydrocarbon-bearing formation. Forms of well completion components may be installed in the wellbore in order to control and enhance efficiency of producing fluids from the reservoir. Some of the equipment utilized in the drilling, completion, and or production of the well is actuated from one position to another.

SUMMARY

An actuation method according to one or more embodiments includes axially translating an operator in a first direction in response to applying a tubing pressure to a first side in excess of an annulus pressure acting on a second side, axially translating the operator in a second direction to an actuation position in response to applying an underbalance pressure level to the operator and operating a tool element from a first position to a second position in response to translating the operator to the actuation position. A downhole tool in accordance to one or more embodiments includes an operator to actuate a tool element in response to movement of the operator to an actuation position. The operator is moved to the actuation position in response to an underbalance pressure level being applied to the operator. In accordance to one or more embodiments, a well system includes downhole tool deployed in a wellbore on tubing, an operator of an actuator is coupled with the downhole tool to change the position of the downhole tool in response to moving the operator to an actuation position. The operator is moved in a first direction in response to tubing pressure being greater than annulus pressure and the operator is moved in a second direction to the actuation position in response to an underbalanced pressure level applied to the operator.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of underbalance actuators and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
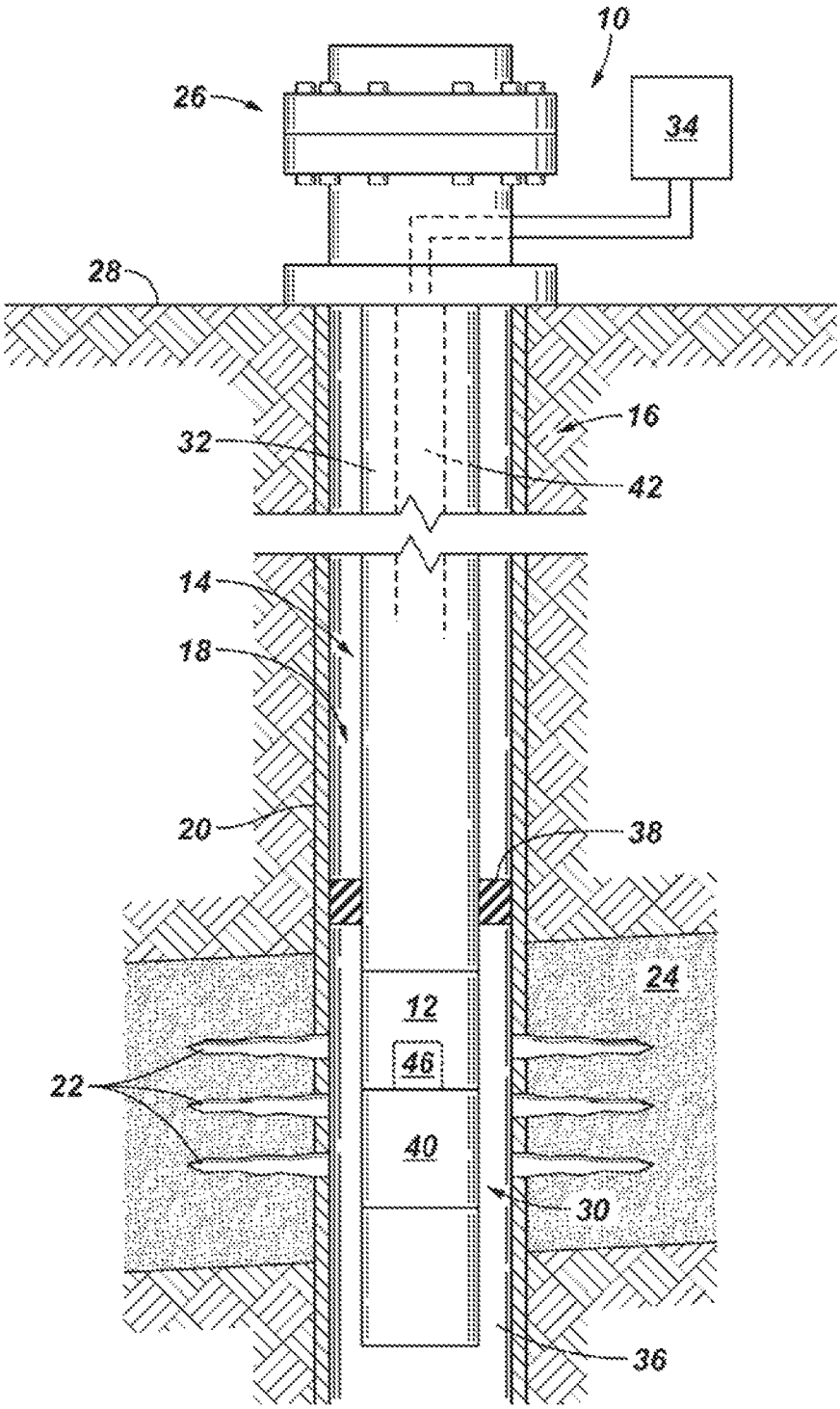
FIG. 1 illustrates a well system in which embodiments of underbalance actuators and methods can be utilized.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect," "connection," "connected," "in connection with," and "connecting" are used to mean "in direct connection with" or "in connection with via one or more elements," and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "top" and "bottom," and other like terms indicating relative positions to a given point or element are utilized to more clearly describe some elements. Commonly, these terms relate to a reference point as the surface from which drilling operations are initiated as being the to point and the total depth being the lowest point, wherein the well (e.g., wellbore, borehole) is vertical, horizontal or slanted relative to the surface. In this disclosure, "hydraulically coupled," "hydraulically connected," and similar terms, may be used to describe bodies that are connected in such a way that fluid pressure may be transmitted between and among the connected items.

FIG. 1 illustrates an example of a well system 10 in which embodiments of underbalance actuators, generally denoted by the numeral 12, may be utilized. The illustrated well system 10 comprises a well completion 14 deployed for use in a well 16 having a wellbore 18. Wellbore 18 may be lined with casing 20 for example having openings 22 (e.g., perforations, slotted liner, screens) through which fluid is able to flow between the surrounding formation 24 and wellbore 18. Completion 14 is deployed in wellbore 18 below a wellhead 26 disposed at a surface 28 (e.g., terrestrial surface, seabed).

Actuator 12 is operationally connected with a tool element 40 to form a downhole tool 30. In the depicted embodiment, downhole tool 30 is deployed in wellbore 18 on a tubular string 32. Tubular string 32, also referred to as tubing 32, may be formed by interconnected sections of threaded pipe, continuous lengths of pipe (e.g., coiled tubing, flexitubo), and the like providing an axial bore 42. Although downhole tool 30 is depicted as being disposed in a vertical portion of wellbore 18, downhole tool 30 may be disposed in a lateral or deviated section. An annular region, or annulus 36, is located between the interior surface of wellbore 18, for example casing 20, and the exterior surface of downhole tool 30. Annulus 36 may be sealed off by an annular seal or packer 38. The pressure in annulus 36 may be referred to in some embodiments as the casing or annulus pressure.

In a non-limiting example, downhole tool 30 is described as a valve, for example a formation isolation valve, and tool element 40 may be a ball-type valve control element or a flapper-type valve control element. Other types of tool elements, for example sleeves, are contemplated and considered within the scope of the appended claims. Downhole tool 30 is a device having two or more operating positions (i.e., states), for example, open and closed positions, and partially opened (e.g., choked) fluid control positions. Examples of downhole tool 30 include without limitation, valves such as formation isolation valves ("FIV"), inflow-outflow control devices ("ICD"), flow control valves ("FCV"), chokes and the like, as well other downhole devices.

Actuator 12 operates tool element 40 for controlling the state, for example open or closed, of tool element 40. Actuator 12 is an interventionless apparatus, also known as a trip saving device, facilitating remote actuation of tool element 40, for example from surface 28. In this regard, actuator 12 of downhole tool 30 may be remotely operated by manipulating the pressure, herein called the tubing pressure, inside of tubular string 32. The tubing pressure may be manipulated for example by operation of pump 34 to increase and decrease the tubing pressure. Actuator 12 may include a counter mechanism 46 (e.g., indexer, J-slot) that prevents actuator 12 from changing the position of tool element 40 until a number or sequence of pressure cycles are applied. A pressure cycle may be completed by increasing the tubing pressure and the subsequent bleed-down of the tubing pressure.

According to some embodiments, actuator 12 is operable to actuate tool element 40 from one state to another state, for example from dosed to open, when downhole tool 30 is underbalanced. A device is underbalance when the annulus pressure is greater than the tubing pressure. Accordingly, tool element 40 actuates when tubing pressure is bled off during the last pressure cycle of counter 46. Opening downhole tool 30 in an underbalance state may create a surge of fluid flow from formation 21 into tubing 32 across the opened tool element 40.

According to some embodiments, actuator 12 is operated to an actuation position in response to applying, or creating, an underbalance pressure level, or differential, of the annulus pressure being greater than the tubing pressure plus a biasing pressure (e.g., underbalance biasing pressure). In some embodiments, the actuating underbalance pressure level is preselected.

Figure 2:
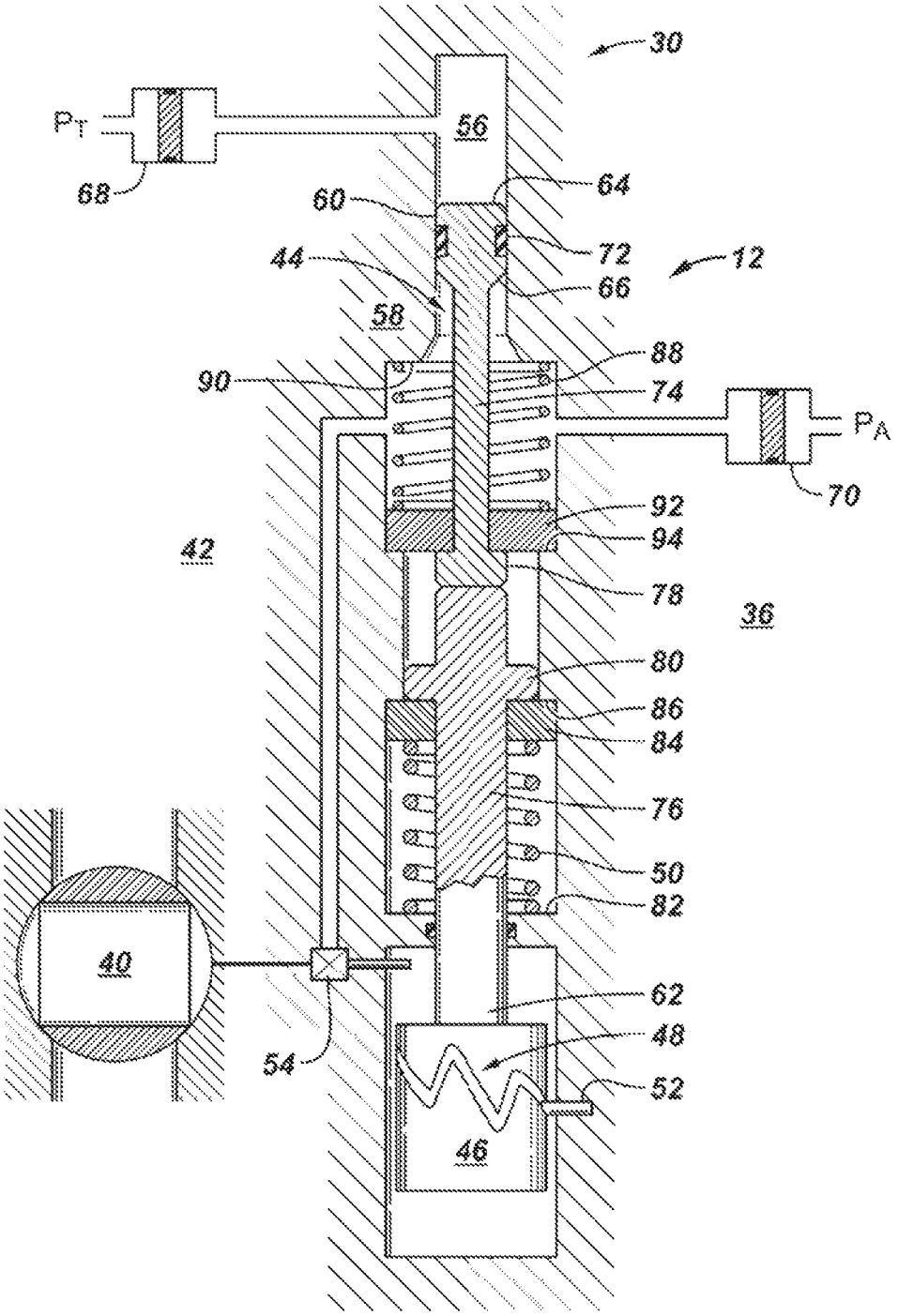
FIGS. 2 to 4 illustrate examples of downhole tools incorporating underbalance actuators in accordance with one or more embodiments.

FIG. 2 is a schematic illustration of an example of a downhole tool 30 incorporating an actuator 12 and a tool element 40 in accordance to one or more embodiments. For example, and without limitation, downhole tool 30 may be formation isolation valve used for example in a completion to isolate the formation from the tubing string. In the depicted embodiment, tool element 40 is illustrated as a ball-type valve closure member. Tool element 40 is illustrated in FIG. 2 in a closed position blocking fluid flow between annulus 36 and axial bore 42.

Tool element 40 is actuated remotely using surface applied tubing pressure ($P_T$) cycles. In the depicted embodiment, the applied tubing pressure acts against a cycle spring 50 and annulus 36 pressure ($P_A$) to axially displace an operator 44 (e.g., mandrel, piston). As operator 44 axially translates back and forth with each pressure up and subsequent pressure bleed down, a counter mechanism 46, that is operationally coupled with operator 44, "counts" the number of applied pressure cycles. For example, a pin 52 tracks along a pattern 48 (e.g., J-slots) with each pressure up (FIG. 3) and pressure bleed down (FIG. 2). The geometry (i.e., logic) of pattern 48 dictates for example rotation of the operator and a housing or sleeve relative to one another. Operator 44 and the housing or sleeve may have respective lugs that align and shoulder against each other to constrain the axial translation of operator 44. The last slot in a pattern 48 sequence misaligns the lugs and allows operator 44 to axially translate further in one direction to an actuation position, see FIG. 4, than previously allowed, see FIG. 2, and thereby actuate tool element 40 of downhole tool 30. This is known as the "long slot" and actuation (e.g., opening) of tool element 40 occurs on this pressure cycle bleed down in accordance with embodiments. Movement of operator 44 on the long slot to the actuation position may actuate tool element 40 in various manners, for example, electrically, mechanically and/or hydraulically. According to one or more embodiments, operator 44 is operationally connected to tool element 40 via switch 54 (e.g., pilot valve) that upon activation opens hydraulic communication from a pressure source, e.g., annulus pressure, and tool element 40 (e.g., tool operator).

Operator 44 is illustrated reciprocally positioned in a chamber 56 (e.g., cylinder) of a housing 58 to move axially up and down in response to tubing pressure cycles. As will be understood by those skilled in the art, housing 58 may be the outer tubular housing of downhole tool 30, which is generally coaxial with axial bore 42.

According to some embodiments, operator 44 extends generally from a piston head 60 to a distal end 62 which may be operationally connected to counter mechanism 46. Piston head 60 has a first side 64, or tubing side, open to tubing pressure $P_T$, for example through compensator 68, and a second side 66, or annulus side, open to annulus 36 pressure $P_A$, for example through compensator 70. Piston head 60 may have a seal 72 separating first side 64 and second side 66.

Operator 44 is depicted as including a cycle rod 74 and a spring rod 76. Cycle rod 74 and spring rod 76 may be sections of a unitary operator 44 member or separate members. Cycle rod 74 extends generally from piston head 60 to a cycle head 78. In accordance to one or more embodiments, cycle bead 78 has a larger outside diameter than the intermediate section of cycle rod 74. Spring rod 76 extends generally from distal end 62 to a spring head 80 located proximate to cycle head 78.

Cycle spring 50 is disposed with spring rod 76 between a bottom fixed stop 82 and an axially movable spring cap 84. Spring cap 84 is positioned in chamber 56 between bottom fixed stop 82 and a top shoulder 86 and spring cap 84 is positioned between spring head 80 and distal end 62. Cycle spring 50 urges spring cap 84 toward top shoulder 86 and provides a selective biasing force against the tubing pressure $P_T$ acting on piston had 60. Cycle spring 50 is a biasing element such as, but not limited to, mechanical coiled springs, Belleville washers, leaf springs, gas springs and other resilient materials. The biasing force may be referred to in terms of the equivalent pressure acting on the piston head 60, for example as a biasing pressure.

Actuator 12 includes an underbalance spring 88 disposed with cycle rod 74 to selectively provide a downward biasing force to operator 44. This downward biasing force may be referred to as an underbalance biasing force or underbalance biasing pressure to correspond with the associated tubing and annulus pressures. Underbalance spring is a biasing element such as, but not limited to, mechanical coiled springs, Belleville washers, leaf springs, gas springs and other resilient materials.

Underbalance spring 88 is disposed between as top fixed stop 90 and an axially movable cycle cap 92. Cycle cap 92 is positioned in chamber 56 between top fixed stop 90 and a bottom shoulder 94 and cycle cap 92 is positioned between cycle head 78 and piston head 60. Underbalance spring 88 biases cycle cap 92 toward bottom shoulder 94. Underbalance spring 88 is utilized to provide a biasing force to control, or set, the underbalance pressure at which tool element 40 is actuated. For example, according to some embodiments, underbalance spring 88 is utilized to increase the pressure differential needed between the annulus pressure $P_A$ and the tubing pressure $P_T$ to translate operator 44 to the actuation position illustrated in FIG. 4. Increasing the underbalance pressure differential may be utilized to create a production surge from formation 24 into the well and the tubing. For example, increasing the underbalance biasing pressure of underbalance spring 88 acting in the first direction will necessitate a greater pressure differential between the annulus pressure $P_A$ and the tubing pressure $P_T$ to actuated tool element 40.

An example of a method of actuating an underbalanced tool element 40 is now described with reference to FIGS. 1-4. According to some embodiments, the pressure $P_A$ in annulus 36 region is greater than the tubing pressure $P_T$ in bore 42 and downhole tool 30 is in an underbalance condition. In this example, tool element 40 is a valve member initially in the closed position blocking fluid flow between annulus 36 and tubing 32.

To actuate tool element 40 to the open position, actuator 12 is operated through a sequence of tubing pressure cycles defined by counter 46. Tubing pressure $P_T$ acts on first side 64 urging operator 44 in a first direction, referred to as a down, or downhole, direction herein. Annulus pressure $P_A$ acting on second side 66 and cycle spring 50 urge operator 44 in the second direction, referred to as the up, or uphole, direction herein.

Figure 3:
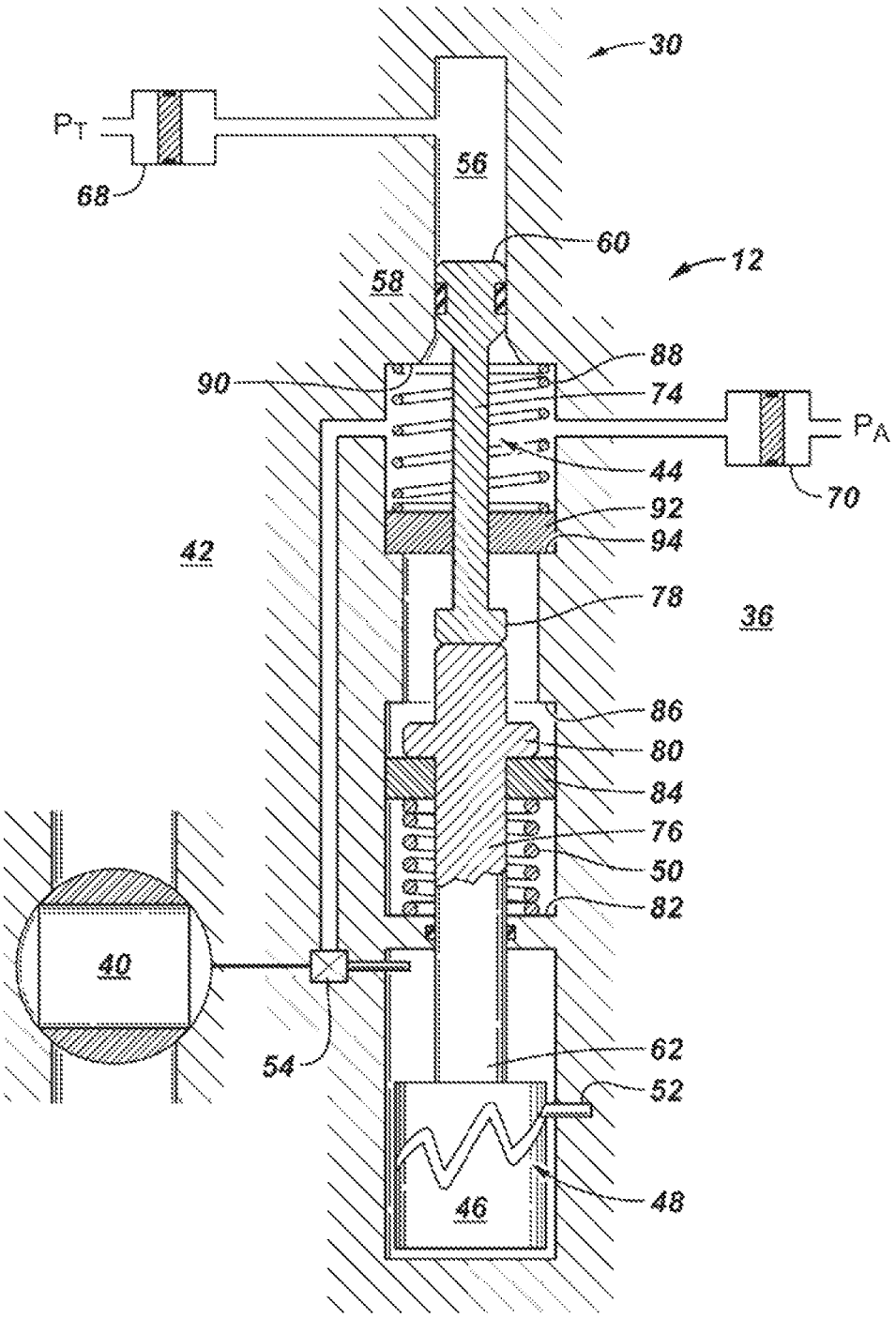

FIG. 3 illustrates tubing pressure $P_T$ increased to a level greater than annulus 36 pressure $P_A$ plus the force of cycle spring 50 thereby translating operator 44 axially in the first direction. As operator 44 is translated in the first direction, cycle spring 50 is compressed. Counter 46 limits the axial movement of operator 44 in the first direction and the second direction, for example according to pattern 48.

FIG. 2 illustrates actuator 12 and downhole tool 30 in the pressure bleed down portion of a pressure cycle that is not an actuation bleed down. When tubing pressure $P_T$ is decreased, annulus pressure $P_A$ and cycle spring 50 urge operator 44 in the second direction. Movable spring cap 84 is illustrated in contact with top shoulder 86 and further axial movement of operator 44 to the actuation position is stopped by counter 46 without regard to the underbalance pressure differential. Tubing pressure cycles, as illustrated by FIGS. 2 and 3, are continued until actuator 12 is cycled through the counter 46 sequence.

FIG. 3 illustrates counter 46 cycled to the last count, or slot, permitting operator 44 to move to the actuation position upon application of the underbalance pressure level controlled by actuator 12. In this example, further movement of operator 44 to the actuation position activates a switch 54 causing actuation of tool element 40.

Figure 4:
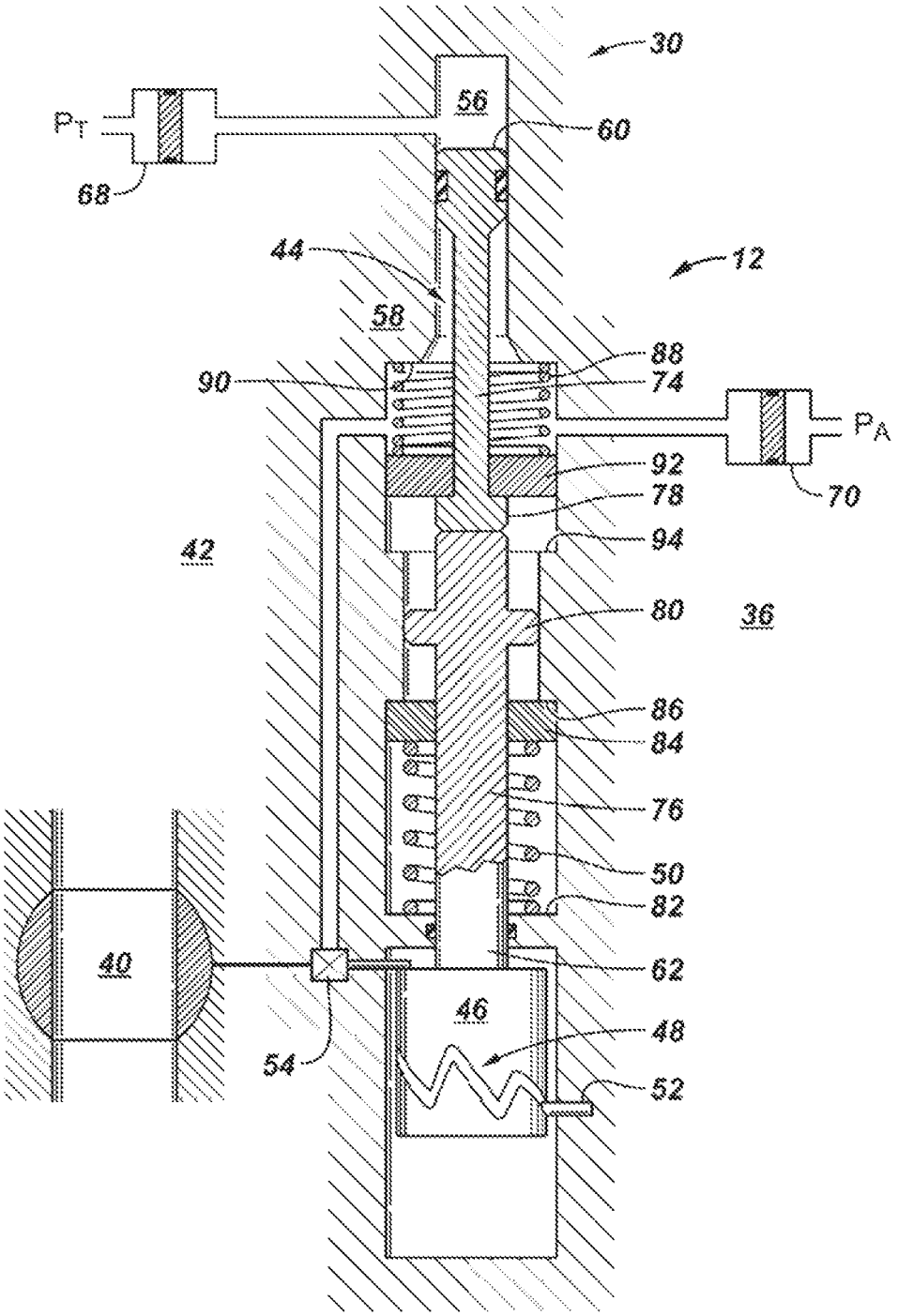

To move operator 44 to the actuation position, as illustrated in FIG. 4, the underbalance pressure actuation pressure level of actuator 12 must be overcome. In other words, annulus pressure $P_A$ is greater than tubing pressure $P_T$ plus the underbalance biasing pressure of underbalance spring 88.

The foregoing outlines features of several embodiments of underbalance actuators and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A downhole tool, comprising:

an operator operationally connected with a tool element to actuate the tool element in response to movement of the operator to an actuation position;

the operator having a first side open to a tubing pressure when installed in a wellbore and a second side open to an annulus pressure when installed in the wellbore;

the operator movable in a first direction in response to the tubing pressure being greater than the annulus pressure;

the operator movable in a second direction to the actuation position in response to an underbalance pressure level applied to the operator;

a cycle spring applying a biasing pressure to the operator in the second direction; and an underbalance spring applying an underbalance biasing pressure to the operator in the first direction, wherein the underbalance pressure level is the annulus pressure greater than the tubing pressure and the underbalance biasing pressure.

2. The downhole tool of claim 1, wherein the underbalance pressure level is the annulus pressure being greater than the tubing pressure plus an underbalance biasing pressure.

3. The downhole tool of claim 1, further comprising an underbalance spring applying an underbalance biasing pressure to the operator in the first direction.

4. The downhole tool of claim 3, wherein the underbalance spring is a mechanical spring.

5. The downhole tool of claim 1, wherein the underbalance spring is a mechanical spring.

6. A well system, comprising:

a downhole tool operable from a first position to a second position deployed in a wellbore on a tubing;

an actuator comprising an operator coupled with the downhole tool to change the position of the downhole tool in response to moving the operator to an actuation position;

the operator having a first side open to a tubing pressure and a second side open to an annulus pressure;

the operator movable in a first direction in response to the tubing pressure being greater than the annulus pressure;

the operator movable in a second direction to the actuation position in response to an underbalance pressure level applied to the operator;

a cycle spring applying a biasing pressure to the operator in the second direction;

an underbalance spring applying an underbalance biasing pressure to the operator in the first direction, wherein the underbalance pressure level is the annulus pressure greater than the tubing pressure and the underbalance biasing pressure.

7. The well system of claim 6, wherein the underbalance pressure level is the annulus pressure being greater than the tubing pressure plus an underbalance biasing pressure acting in the first direction.

8. The well system of claim 6, wherein the actuator further comprises an underbalance spring applying an underbalance biasing pressure to the operator in the first direction.

9. The well systems of claim 8, wherein the underbalance spring is a mechanical spring.

10. The well system of claim 6, wherein the underbalance spring is a mechanical spring.

* * * * *